US007470156B2

(12) United States Patent
Suemitsu et al.

(10) Patent No.: US 7,470,156 B2
(45) Date of Patent: Dec. 30, 2008

(54) ELECTRICAL CONNECTOR

(75) Inventors: Yoshifumi Suemitsu, Tokyo (JP); Kazushige Sakamaki, Tokyo (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 43 days.

(21) Appl. No.: 11/749,789

(22) Filed: May 17, 2007

(65) Prior Publication Data

US 2007/0281555 A1 Dec. 6, 2007

(30) Foreign Application Priority Data

Jun. 2, 2006 (JP) ..... 2006/155009

(51) Int. Cl.
*H01R 13/514* (2006.01)

(52) U.S. Cl. ..... 439/752

(58) Field of Classification Search ..... 439/595, 439/752

See application file for complete search history.

(56) References Cited

U.S. PATENT DOCUMENTS 6,767,259 B2 * 7/2004 Kojima et al. ..... 439/752
6,835,102 B2 * 12/2004 Kayama ..... 439/686
7,347,732 B2 * 3/2008 Ohtaka et al. ..... 439/595
2001/0001086 A1 * 5/2001 Sasaki et al. ..... 439/752

FOREIGN PATENT DOCUMENTS

JP 05-198331 8/1993

* cited by examiner

*Primary Examiner*—Renee Luebke
*Assistant Examiner*—Larisa Tsukerman
(74) *Attorney, Agent, or Firm*—Barley Snyder LLC

(57) ABSTRACT

An electrical connector includes a housing having opposing upper and lower surfaces and opposing rear and front surfaces. The housing has a recessed member provided with a plurality of contacts arranged in at least one row that extend from the rear surface toward the front surface of the housing. A lance block is inserted into the housing from the bottom surface. The lance block has elastic lances corresponding to the contacts that engage the contacts to primarily lock the contacts in the housing. A side retainer is inserted into the housing from the bottom surface. The side retainer presses the lance block toward the front surface when the side retainer is moved from a temporary locking position into a main locking position to lock the lance block in the housing. The side retainer secondarily locks the contacts in the housing in the main locking position.

18 Claims, 15 Drawing Sheets

ELECTRICAL CONNECTOR

CROSS-REFERENCE TO RELATED APPLICATIONS

This application claims the benefit of the filing date under 35 U.S.C. § 119(a)-(d) of Japan Patent Application No. 2006-155009, filed Jun. 2, 2006.

FIELD OF THE INVENTION

The present invention relates to an electrical connector having a housing provided with a plurality of contacts wherein the contacts are primarily locked in the housing by a lance block and secondarily locked in the housing by a side retainer.

BACKGROUND

In recent years, there has been a demand for a reduction in the height and width of electrical connectors used for the purpose of electrically connecting an automotive circuit board and electrical wiring or the like. With such an electrical connector, it is necessary to form in the housing numerous contact accommodating cavities for accommodating contacts and numerous housing lances for fastening the contacts in place. The formation of contact accommodating cavities and housing lances is generally accomplished simultaneously with the molding of a housing using a mold. However, as the reduction in the height and width of electrical connectors progresses, it is becoming difficult to form housing lances by molding using a conventional mold. A construction has therefore been adopted in the past in which housing lances are formed by molding without providing interpole walls between adjacent contact accommodating cavities on the mating surface of the housing to reduce the height and the width of the electrical connector.

However, although this construction is convenient for forming housing lances by molding using a mold, because no interpole walls are provided on the mating surface between the adjacent contact accommodating cavities, there is a problem in that the mechanical strength of the housing is low. Additionally, because no interpole walls are provided on the mating surface between the adjacent contact accommodating cavities, a tool insertion hole for the insertion of a tool cannot be formed for each of the contact accommodating cavities. Thus, it is difficult to guide the tip end of the release tool to the position of a contact that is desired to be released from the housing, because the pitch becomes increasingly narrow and interferes with the release operation of the housing lances.

FIGS. 14-15 (see JP 05-198331) show an electrical connector of the prior art wherein the formation of housing lances is not performed simultaneously with the molding of the housing using a mold. In the electrical connector shown in FIGS. 14-15, a latch member that is a separate body from the housing is provided, thus making it possible to hold contacts reliably in the respective contact accommodating cavities. As shown in FIGS. 14-15, the electrical connector 101 comprises a housing 110, a latch member 120, a contact position securing member 130, and a plurality of contacts 140. The housing 110 is formed in a substantially rectangular solid shape. A plurality of contact accommodating cavities 111 are formed in two rows (upper and lower rows) in the housing 110, as shown in FIG. 14. Each of the contact accommodating cavities 111 extends in the forward-rearward direction of the housing 110 (left-right direction in FIG. 15). A latch receiving slot 112 that extends in the left-right direction (direction perpendicular to the plane of page in FIG. 15) and in the forward-rearward direction of the housing 110 is formed between the upper and lower contact accommodating cavities 111. The contacts 140 are designed to be accommodated inside the individual contact accommodating cavities 111 from the rear of the housing 110, as shown in FIG. 15. An electrical wire W is connected to each of the contacts 140.

The latch member 120 has a base 121 that extends in the row direction of the contact accommodating cavities 111, as shown in FIG. 14. The base 121 is provided with a plurality of elastic arms 122, 123 that extend forward from the base 121 in two rows. The latch member 120 is designed to be inserted into the latch receiving slot 112 of the housing 110 from the front of the housing 110. The elastic arms 122 are provided with locking members 122*a* that protrude into the upper contact accommodating cavities 111. The elastic arms 123 are provided with locking members 123*a* that protrude into the lower contact accommodating cavities 111. The locking members 122*a* of the elastic arms 122 are used for the primary locking of the contacts 140 that are accommodated inside the upper contact accommodating cavities 111, while the locking members 123*a* of the elastic arms 123 are used for the primary locking of the contacts 140 that are accommodated inside the lower contact accommodating cavities 111, as shown in FIG. 15. Notches 122*b* that engage with the inner surface 111*a* of the front portion of the housing 110 are formed at the front ends of the elastic arms 122. Notches 123*b* that engage with the inner surface 111*a* of the front portion of the housing 110 are formed at the front ends of the elastic arms 123. As a result of the notches 122*b*, 123*b* engaging with the inner surface 111*a* of the front portion of the housing 110, the latch member 120 is prevented from dropping out of the latch receiving slot 112.

The contact position securing member 130 is temporarily locked in a first position of the housing 110 from the rear of the housing 110 and moved from the first position to the final position so that main locking is accomplished. FIG. 15 shows a state in which the main locking of the contact position securing member 130 with the housing 110 is accomplished. In the main locking state, the upper tongues 131 of the contact position securing member 130 contact the rear portions of the contacts 140 whose primary locking is performed by the locking members 122*a* of the upper elastic arms 122, thus accomplishing the secondary locking of the contacts 140. In the main locking state, the lower tongues 132 of the contact position securing member 130 contact the rear portions of the contacts 140 whose primary locking is performed by the locking members 123*a* of the lower elastic arms 123, thus accomplishing the secondary locking of the contacts 140.

In the electrical connector 101, a latch member 120 that is a separate body from the housing 110 is provided, which makes it possible to hold the contacts 140 reliably in the contact accommodating cavities 111 and to provide interpole walls between adjacent contact accommodating cavities on the mating surface of the housing 110, so that the mechanical strength of the housing 110 is not lowered. The formation of a tool insertion hole for each of the contact accommodating cavities 111 is also possible.

Several problems, however, have been encountered in the electrical connector 101 shown in FIGS. 14-15. Specifically, in the electrical connector 101, the latch receiving slot 112 that receives the latch member 120 is formed between the two rows (upper and lower rows) of contact accommodating cavities 111 in the housing 110, so that the latch member 120 is inserted into the latch receiving slot 112 from the front of the housing 110. Therefore, the height of the electrical connector 101 in the vertical direction cannot be reduced. If a low profile is to be achieved by making the housing walls thinner in the construction of the electrical connector 101 shown in FIGS. 14-15, then the shape of the latch member 120 itself will inevitably be made more compact as well, making it difficult to obtain a construction in which the latch member 120 is properly held in the housing 110. Accordingly, in cases where a low profile is achieved by making the housing walls thinner in the construction of the electrical connector 101 shown in FIGS. 14-15, there is a problem in that the latch member 120 cannot be properly held, so that a sufficient contact holding force cannot be obtained.

BRIEF SUMMARY

It is therefore an object of the present invention to provide an electrical connector that can obtain a sufficient contact holding force even if the height in the vertical direction and the width in the left-right direction are reduced by reducing the thickness of the housing walls.

This and other objects are achieved by an electrical connector comprising a housing having opposing upper and lower surfaces and opposing rear and front surfaces. The housing has a recessed member provided with a plurality of contacts. The contacts are arranged in at least one row and extend from the rear surface toward the front surface of the housing. A lance block is inserted into the housing from the bottom surface. The lance block has elastic lances corresponding to the contacts. The elastic lances engage the contacts to primarily lock the contacts in the housing. A side retainer is inserted into the housing from the bottom surface. The side retainer presses the lance block toward the front surface when the side retainer is moved from a temporary locking position into a main locking position to lock the lance block in the housing. The side retainer secondarily locks the contacts in the housing in the main locking position.

This and other objects are further achieved by an electrical connector comprising a housing having a recessed member provided with a plurality of contacts. The contacts are arranged in at least one row and extend from a rear surface toward a front surface of the housing. A lance block is inserted into the housing in a direction substantially perpendicular to the contacts. The lance block has elastic lances corresponding to the contacts. The elastic lances engage the contacts to primarily lock the contacts in the housing. A side retainer is inserted into the housing in a direction substantially perpendicular to the contacts. The side retainer presses the lance block in a direction substantially parallel to the contacts when the side retainer is moved from a temporary locking position into a main locking position to lock the lance block in the housing. The side retainer secondarily locks the contacts in the housing in the main locking position.

DETAILED DESCRIPTION OF THE EMBODIMENT(S)

Figure 1A:
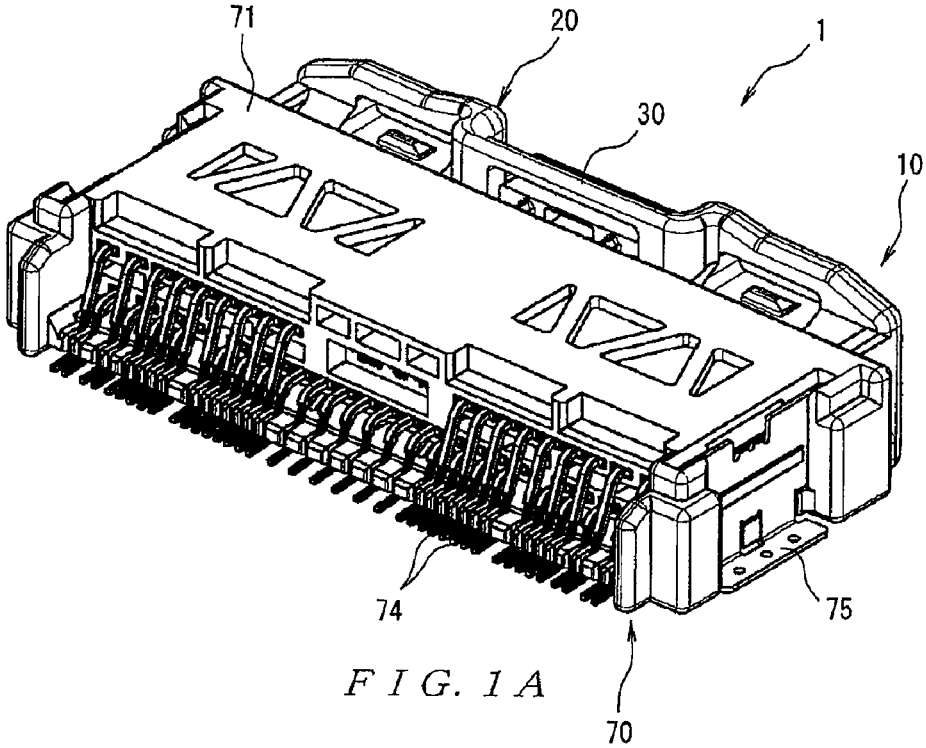
FIG. 1A is a perspective view as seen from a front at an inclination from above of an electrical connector assembly in which an electrical connector according to the present invention is mated with a mating connector.
Figure 1B:
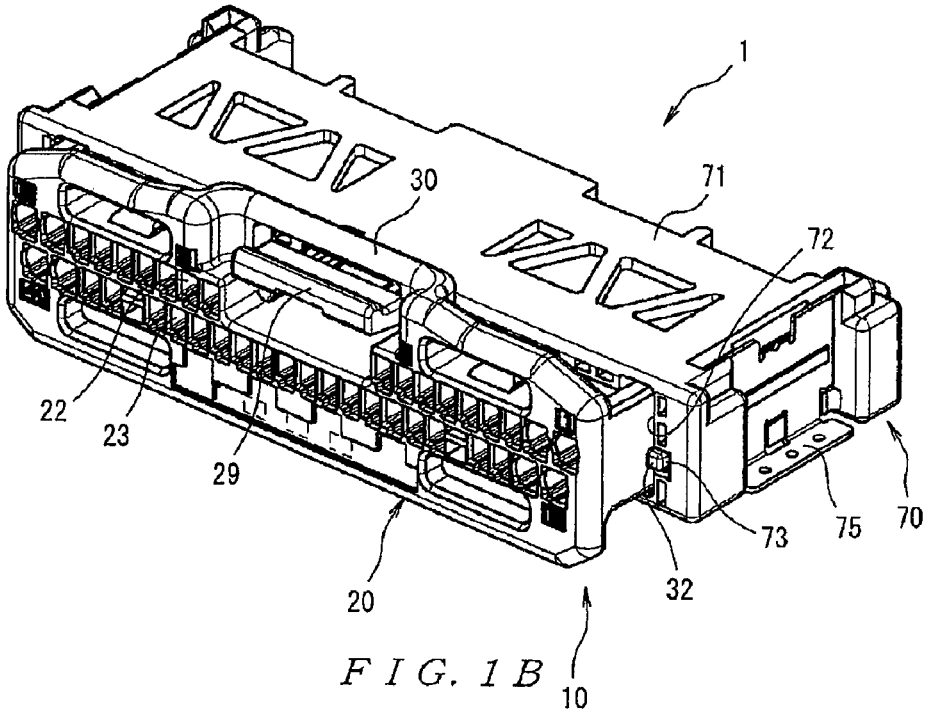
FIG. 1B is a perspective view as seen from a back at an inclination from above of the electrical connector assembly in which the electrical connector according to the present invention is mated with the mating connector.

FIGS. 1A-1B show an electrical connector assembly 1 consisting of an electrical connector 10 according to the present invention mated with a mating connector 70. The mating connector 70 is designed to be mounted on a circuit board (not shown). The mating connector 70 comprises a mating housing 71 having an electrical connector receiving recessed member 72. Grooves 73 are formed in the mating connector 70 adjacent to the electrical connector receiving recessed member 72. Mating contacts 74 are attached in two rows (upper and lower rows) to the housing 71. The mating contacts 74 are constructed, for example, from pin-form male contacts. A fastening fitting 75 extends from the housing 71 and is used for fastening to the circuit board (not shown) to the mating connector 70.

As shown in FIGS. 2A-3B, the electrical connector 10 comprises a housing 20. The housing 20 has a substantially rectangular solid shape extending in the left-right direction. The housing 20 consists of a front surface 21*a*, a rear surface 21*b*, an upper surface 21*c*, a lower surface 21*d*, a left side surface 21*e*, and a right side surface 21*f*. The front surface 21*a* of the housing 20 forms a mating surface of the housing 20. The housing 20 may be formed, for example, by molding an insulating resin such as polybutylene terephthalate (PBT).

Figure 10:
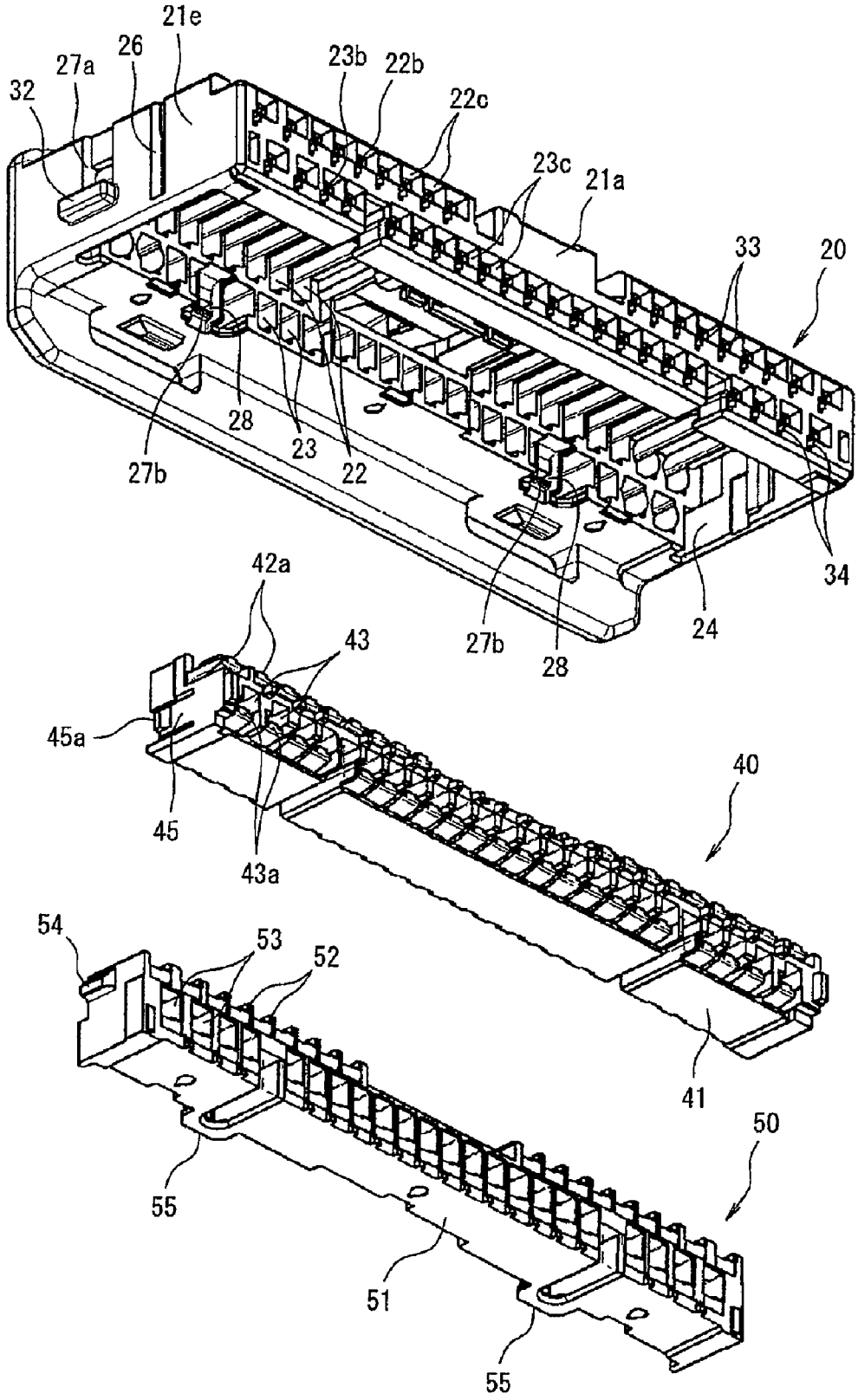
FIG. 10 consists of perspective views of the housing, the lance block, and the side retainer as seen from the front at an inclination from below.
Figure 11:
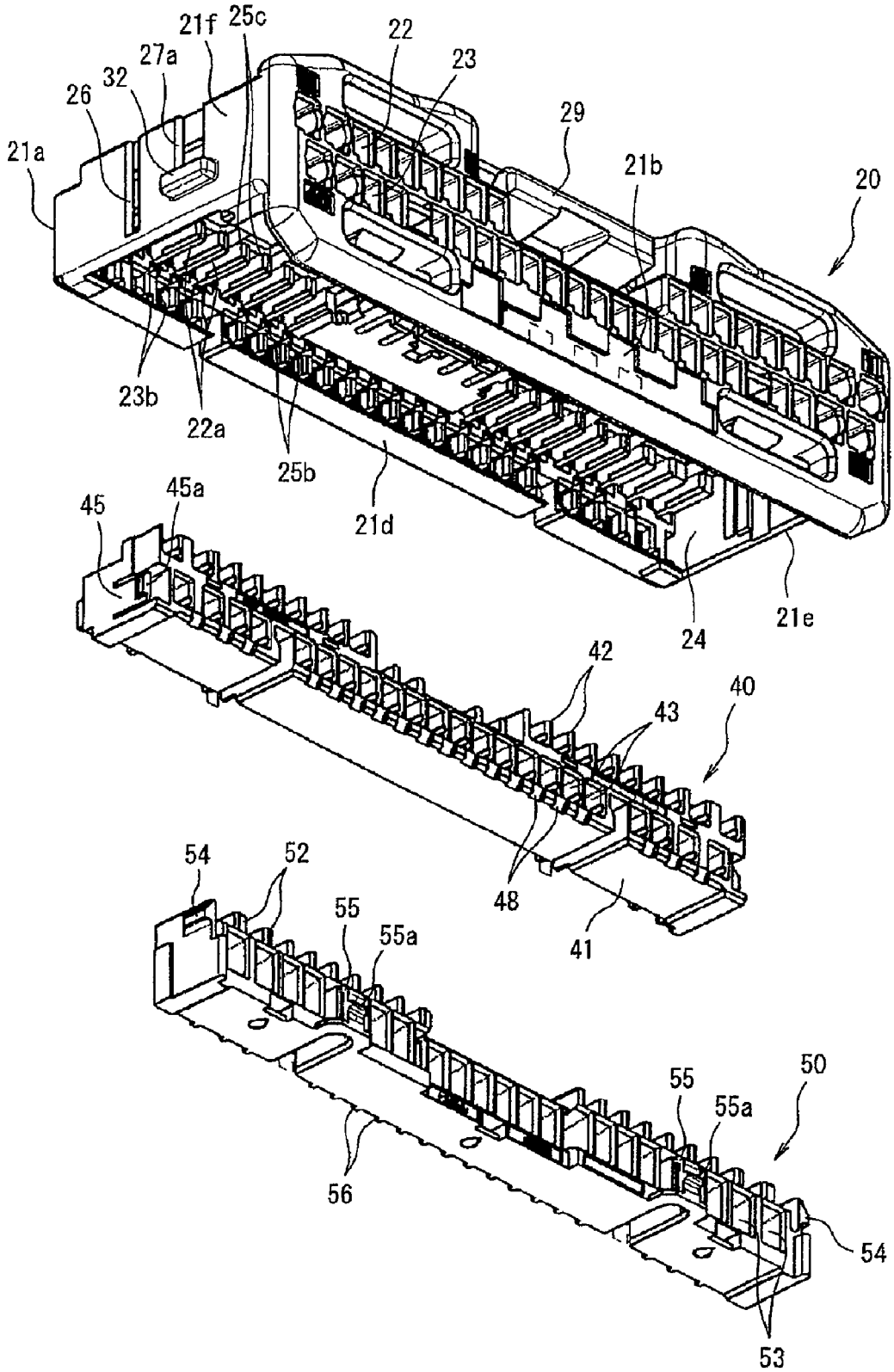
FIG. 11 is a perspective view of the housing, the lance block, and the side retainer as seen from the back at an inclination from below.

As shown in FIGS. 10-11, a recessed member 24 is formed substantially in a central portion of the housing 20 in the forward-rearward direction from the lower surface 21*d* of the housing 20 toward the upper surface 21*c*. First contact insertion holes 22 and second contact insertion holes 23 that are arranged in two rows (upper and lower rows, respectively) at a specified pitch in the left-right direction are formed in the housing 20 in the rear portion of the recessed member 24. The first contact insertion holes 22 and the second contact insertion holes 23 pass from the rear surface 21*b* of the housing 20 through to the recessed member 24. First mating contact insertion holes 22*b* and second mating contact insertion holes 23*b* are formed in the housing 20 in the front portion of the recessed member 24 in positions corresponding to the first contact insertion holes 22 and the second contact insertion holes 23, respectively. Inclined surfaces 22*c*, 23*c* for facilitating the introduction of the mating contacts 74 in the first mating contact insertion holes 22*b* and the second mating contact insertion holes 23*b* are formed at front-end entrances of the first mating contact insertion holes 22*b* and second mating contact insertion holes 23*b*. The first mating contact insertion holes 22*b* and the second mating contact insertion holes 23*b* pass from the front surface 21*a* of the housing 20 through to the recessed member 24.

Figure 9:
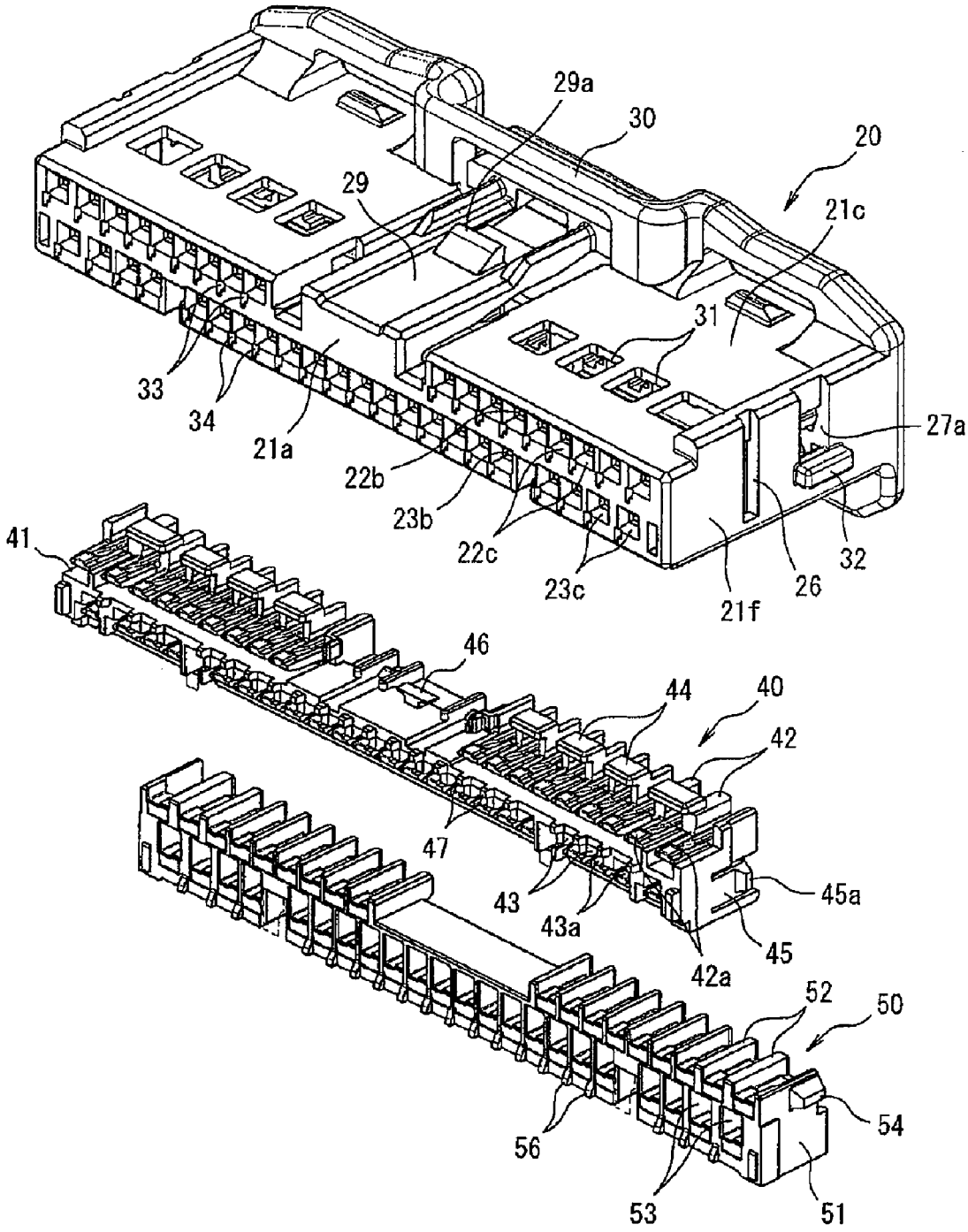
FIG. 9 is a perspective view of the housing, the lance block, and the side retainer as seen from the front at an inclination from above.
Figure 12A:
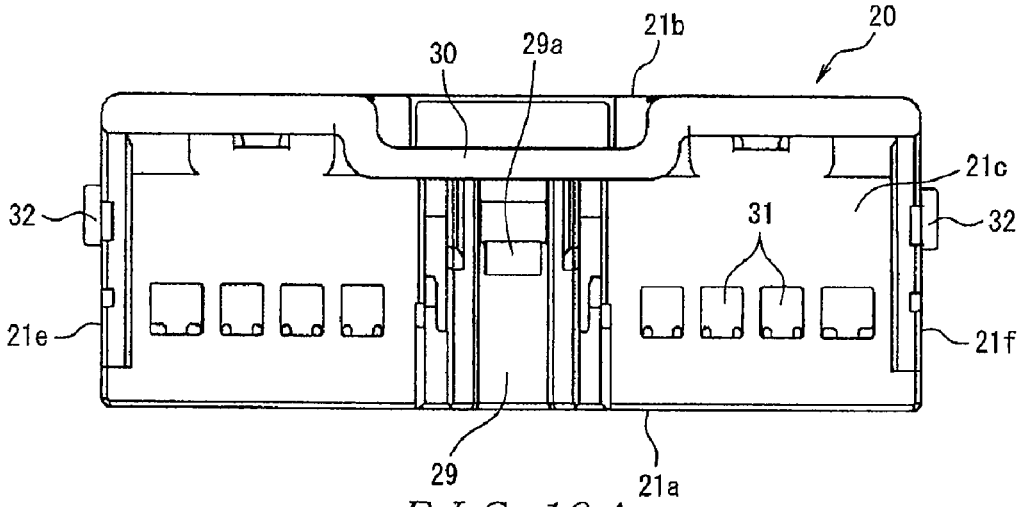
FIG. 12A is a plan view of the housing.
Figure 12B:
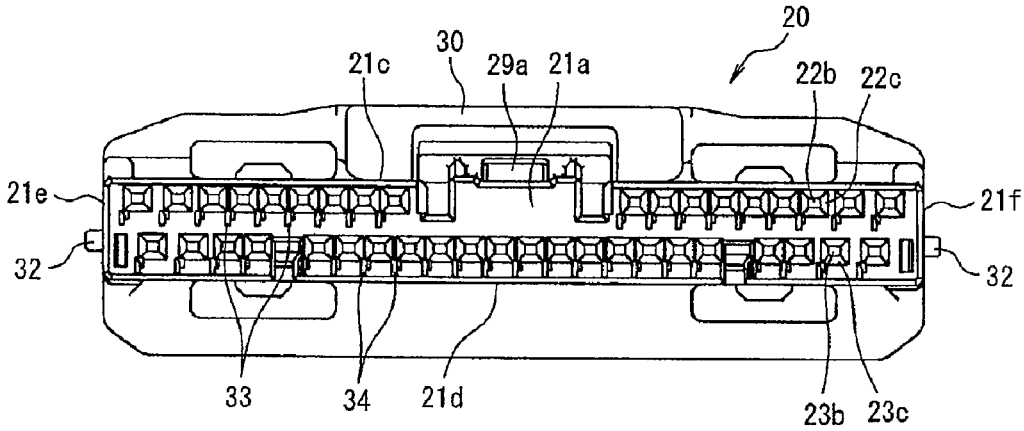
FIG. 12B is a front view of the housing.
Figure 12C:
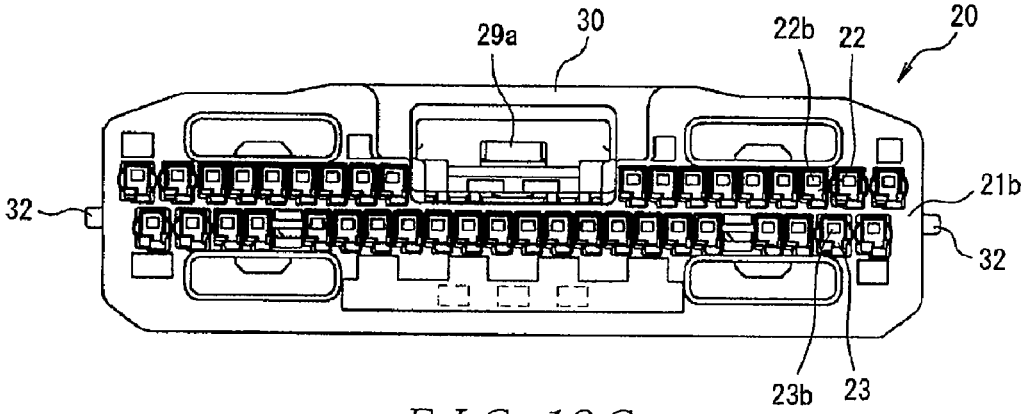
FIG. 12C is a back view of the housing.

As shown in FIG. 11, a plurality of first partition walls 22*a* are provided at the front end of the recessed member 24 of the housing 20 and partition mutually adjacent first mating contact insertion holes 22*b*. The mutually adjacent first partition walls 22*a* are spaced at a distance that allows the accommodation of a first contact 61. Interpole walls are provided on the front surface 21*a* of the housing 20 between mutually adjacent first contact insertion holes 22 and between mutually adjacent second contact insertion holes 23. As shown in FIGS. 9-10 and 12B, a plurality of tool insertion holes 33 corresponding to the first mating contact insertion holes 22*b* are formed in the front surface 21*a* of the housing 20. Similarly, a plurality of tool insertion holes 34 corresponding to the second mating contact insertion holes 23*b* are formed in the front surface 21*a* of the housing 20.

Figure 2A:
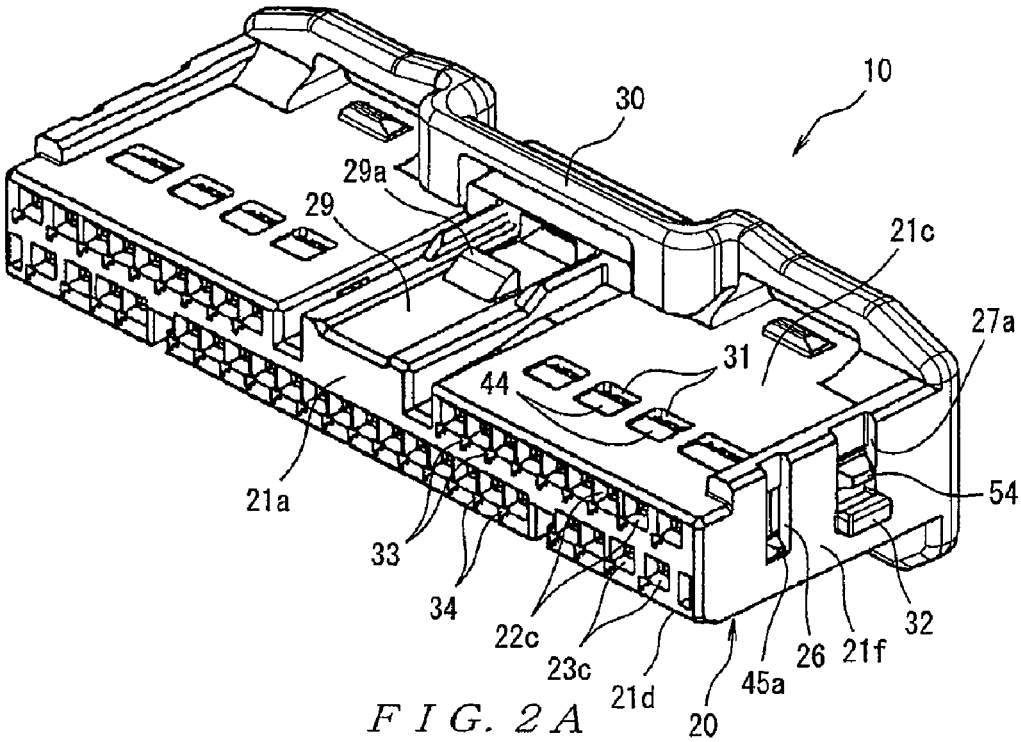
FIG. 2A is a perspective view as seen from the front at an inclination from above of the electrical connector according to the present invention.
Figure 2B:
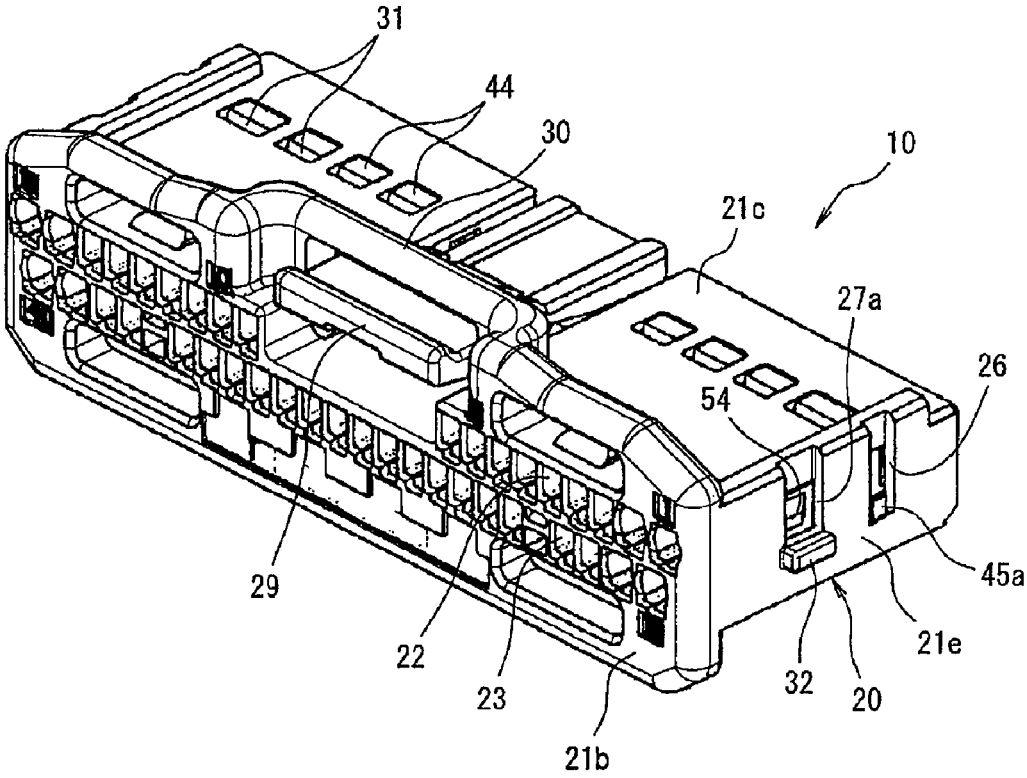
FIG. 2B is a perspective view as seen from the back at an inclination from above of the electrical connector according to the present invention.
Figure 3A:
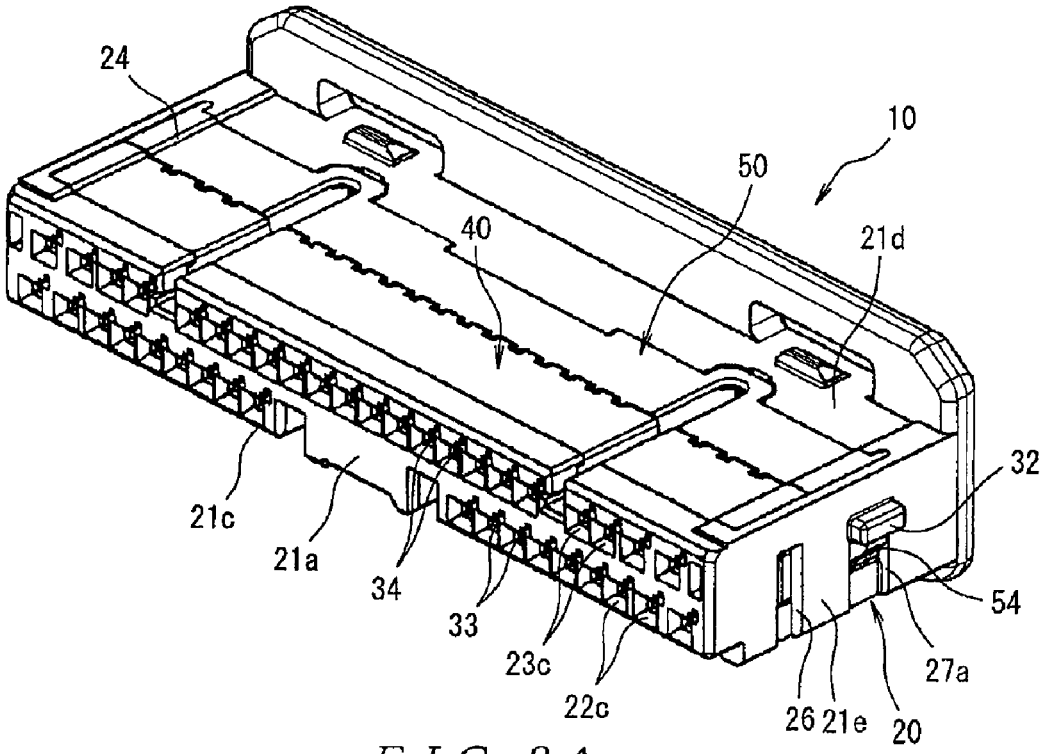
FIG. 3A is a perspective view as seen from the front at an inclination from above of the lower surface of the electrical connector according to the present invention.
Figure 3B:
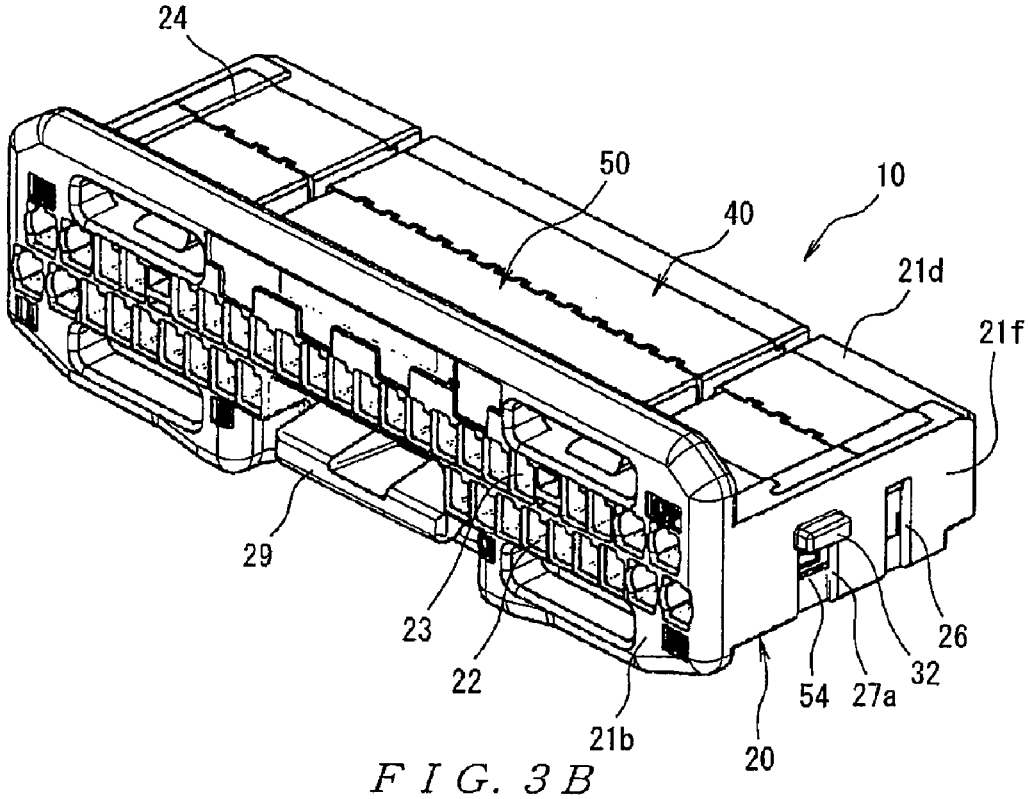
FIG. 3B is a perspective view as seen from the back at an inclination from above of the lower surface of the electrical connector according to the present invention.
Figure 4:
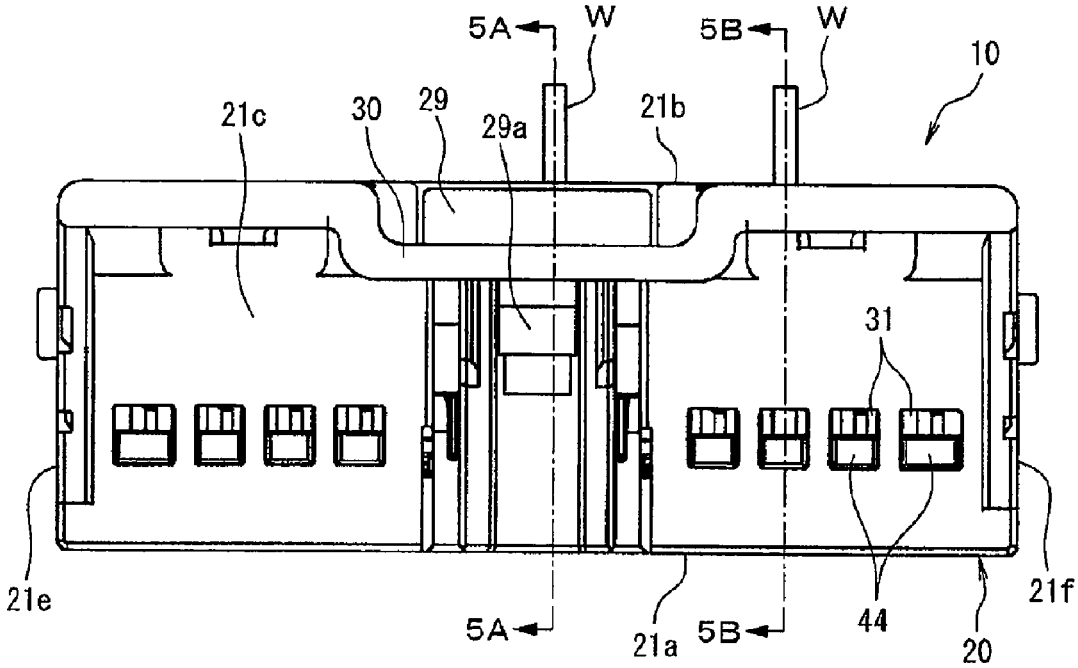
FIG. 4 is a plan view of the electrical connector according to the present invention.
Figure 5B:
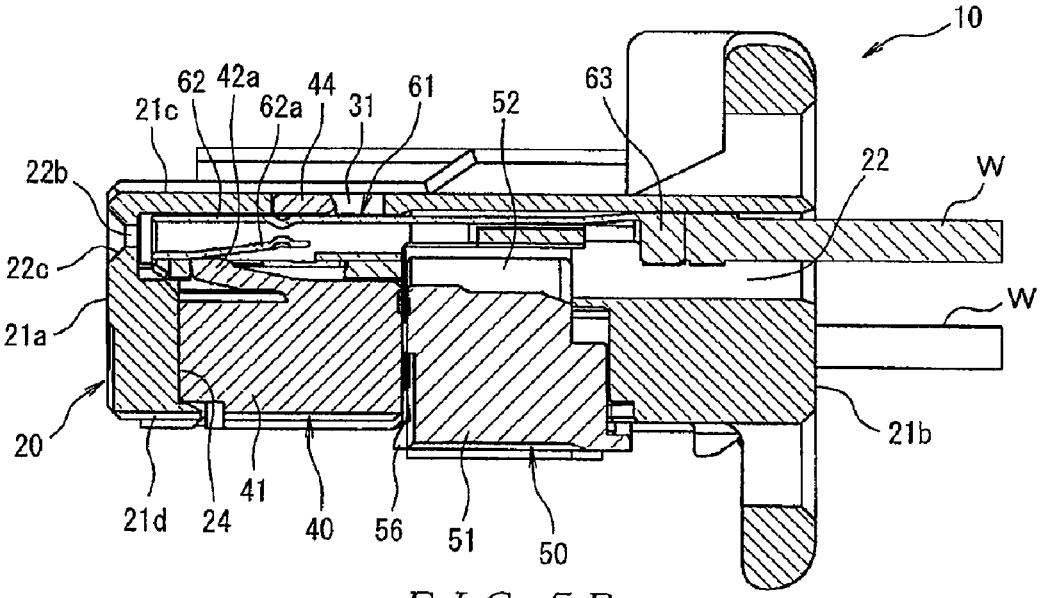
FIG. 5B is a sectional view along line 5B-5B in FIG. 4 showing the temporary locking state of the side retainer in the electrical connector according to the present invention.
Figure 6A:
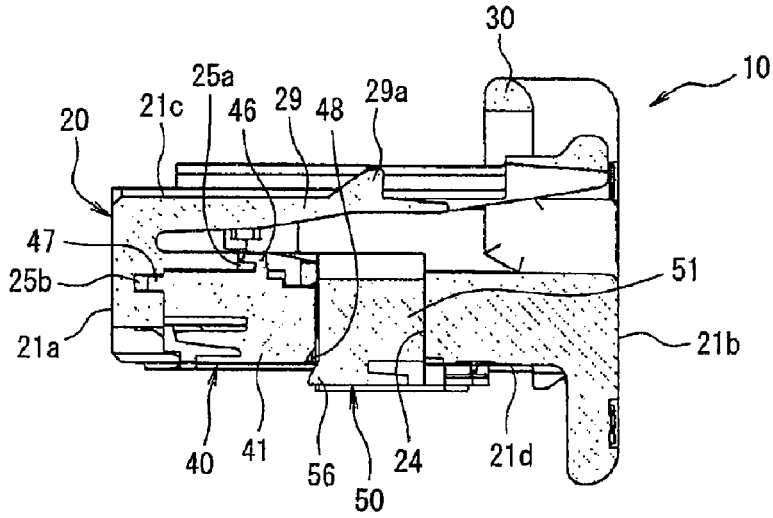
FIG. 6A is a sectional view of the temporary locking state of the side retainer in the electrical connector according to the present invention in which both a first positioning projection and a second positioning projection of a lance block are cut.
Figure 6B:
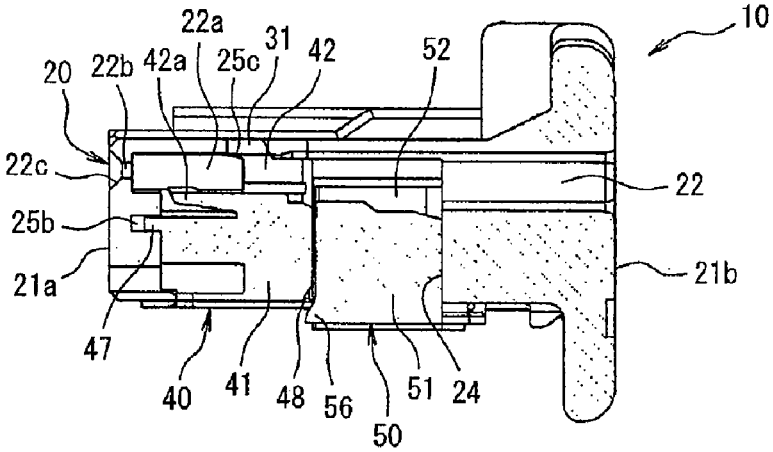
FIG. 6B is a sectional view of the temporary locking state of the side retainer in the electrical connector according to the present invention in which both the second positioning projection of the lance block and a first contact insertion hole in a housing are cut.
Figure 6C:
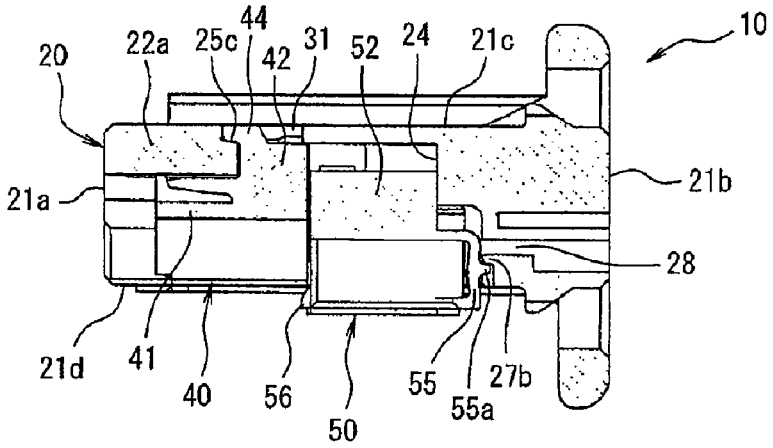
FIG. 6C is a sectional view of the temporary locking state of the side retainer in the electrical connector according to the present invention in which both a third positioning projection of the lance block and a main locking projection of the side retainer are cut.
Figure 13A:
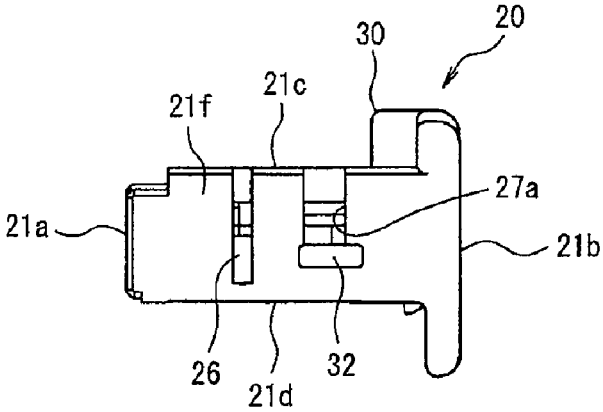
FIG. 13A is a right side view of the housing.
Figure 13B:
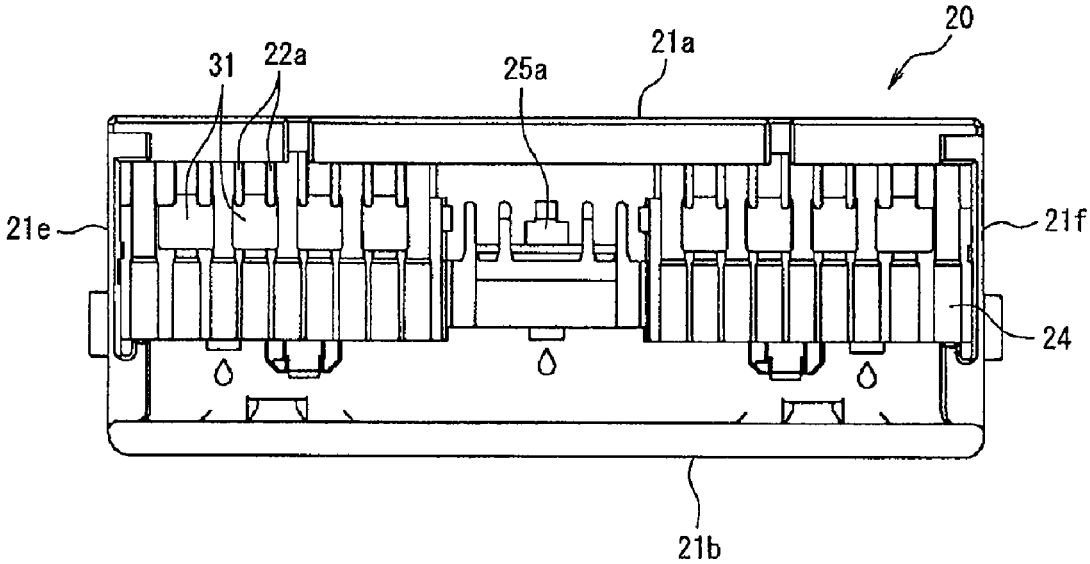
FIG. 13B is a bottom view of the housing.
Figure 14:
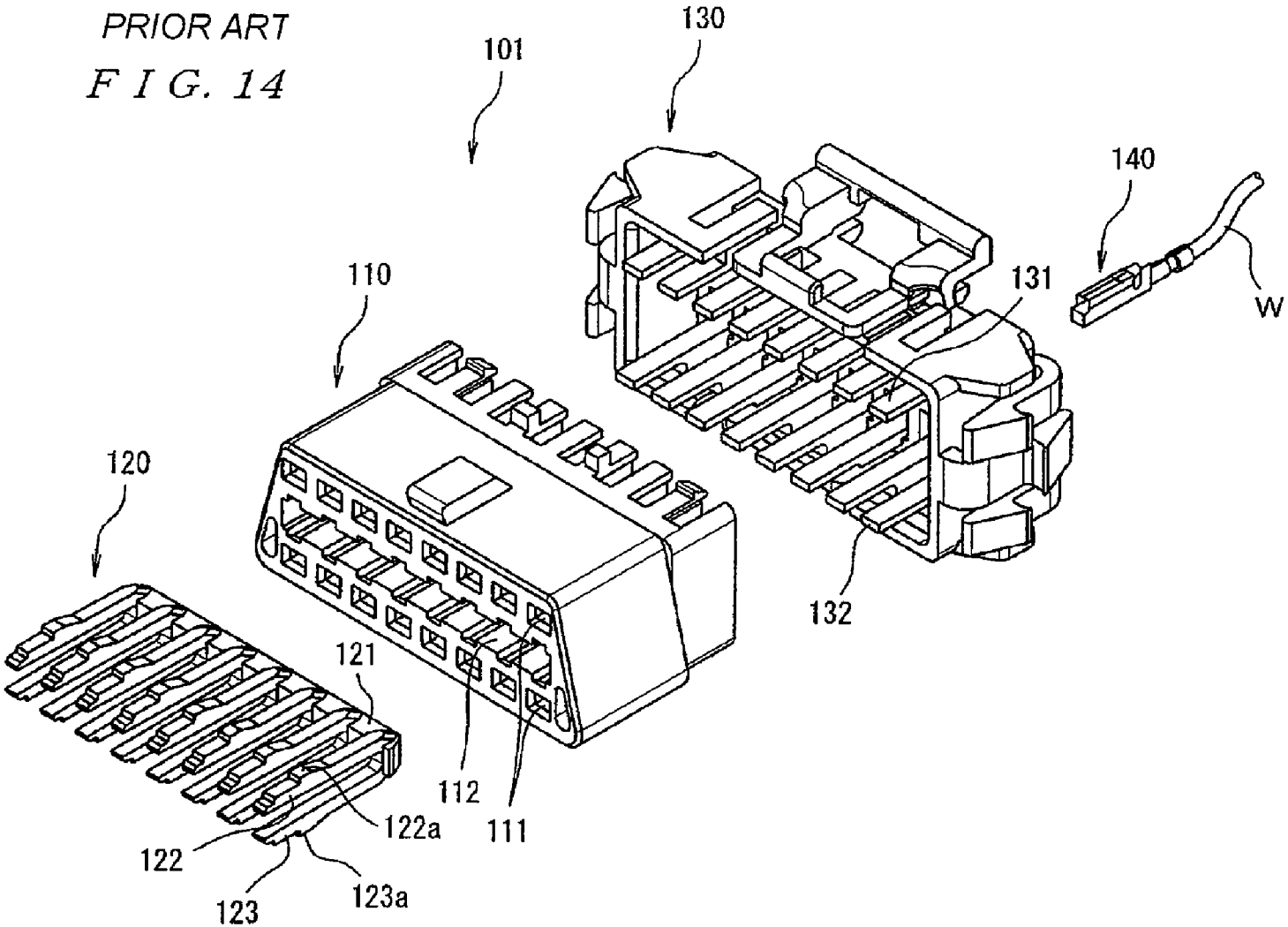
PRIOR ART FIG. 14
FIG. 14 is an exploded perspective view of an electrical connector according to the prior art.
Figure 15:
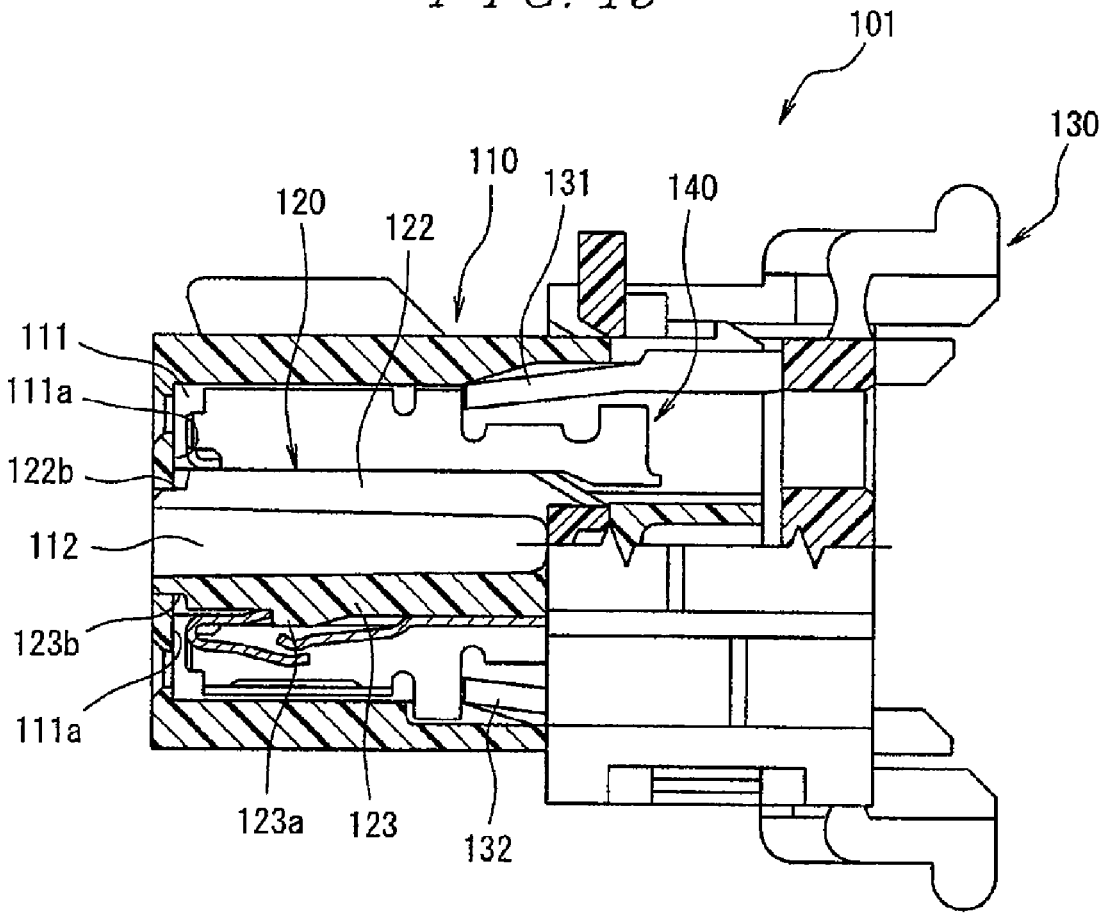
PRIOR ART FIG. 15
FIG. 15 is a sectional view of the electrical connector of FIG. 14 in an assembly completion state.

As shown in FIGS. 6A and 13B, a first positioning projection recessed member 25*a* is formed in the upper surface of the recessed member 24 of the housing 20. A plurality of second positioning projection recessed members 25*b* are formed in the front end surface of the recessed member 24, as shown in FIGS. 6A-6B and 11. As shown in FIGS. 4, 5B, and 6C, a plurality of openings 31 are formed in the upper surface 21*c* of the housing 20 so that the openings 31 pass through to the recessed member 24. Shoulders 25*c* are formed in upper edge portions of the first partition walls 22*a* facing the openings 31. Locking projection openings 26 are formed in the left side surface 21*e* and the right side surface 21*f* of the housing 20. As shown in FIGS. 2A-2B, temporary locking projection openings 27*a* are formed in the left side surface 21*e* and the right side surface 21*f* of the housing 20. As shown in FIGS. 6C and 10, a plurality of protruding members 27*b* are formed on the rear end surface of the recessed member 24 of the housing 20. As shown in FIGS. 8C and 10, slits 28 pass through to the rear end surface of the housing 20 in the rear end surface of the recessed member 24 of the housing 20 above the protruding members 27*b*.

As shown in FIG. 2B, a locking member 29 for locking the mating connector 70 when the mating connector mates is provided on the upper surface 21*c* of the housing 20. A locking projection 29*a* is provided on the locking member 29 substantially in a central portion in the forward-rearward direction. A protection member 30 for protecting the locking member 29 is provided on the upper surface 21*c* of the housing 20. As shown in FIG. 1B, a pair of projections 32 that are fitted into the grooves 73 formed in the mating connector 70 is provided on the left side surface 21*e* and the right side surface 21*f* of the housing 20. When the projections 32 are fit into the grooves 73 formed in the mating connector 70, the projections 32 have the function of restricting the movement of the electrical connector 10 when the electrical connector 10 is caused to move in a vertical direction.

As shown in FIGS. 5A-5B and 7A-7B, a plurality of first contacts 61 and second contacts 65 are accommodated in the two rows (upper and lower rows) in the housing 20. It will be appreciated by those skilled in the art that the first contacts 61 and the second contacts 65 may also be arranged in a single row or more than two rows or only a single type of contact may be provided. The first contacts 61 are designed to be accommodated in the recessed member 24 of the housing 20 by passing through the first contact insertion holes 22 in the upper row from the side of the rear surface of the housing 20, as shown in FIG. 5B. Each of the first contacts 61 is constructed as a female contact and comprises a substantially box-form contact member 62 that receives one of the mating contacts 74 and contacts the mating contact 74. An electrical wire connecting member 63 extends rearward from the contact member 62 and is connected to an electrical wire W. An elastic contact piece 62*a* that contacts one of the mating contacts 74 is provided on each of the contact members 62. Each of the first contacts 61 may be formed, for example, is formed by stamping and forming a metal plate.

Figure 5A:
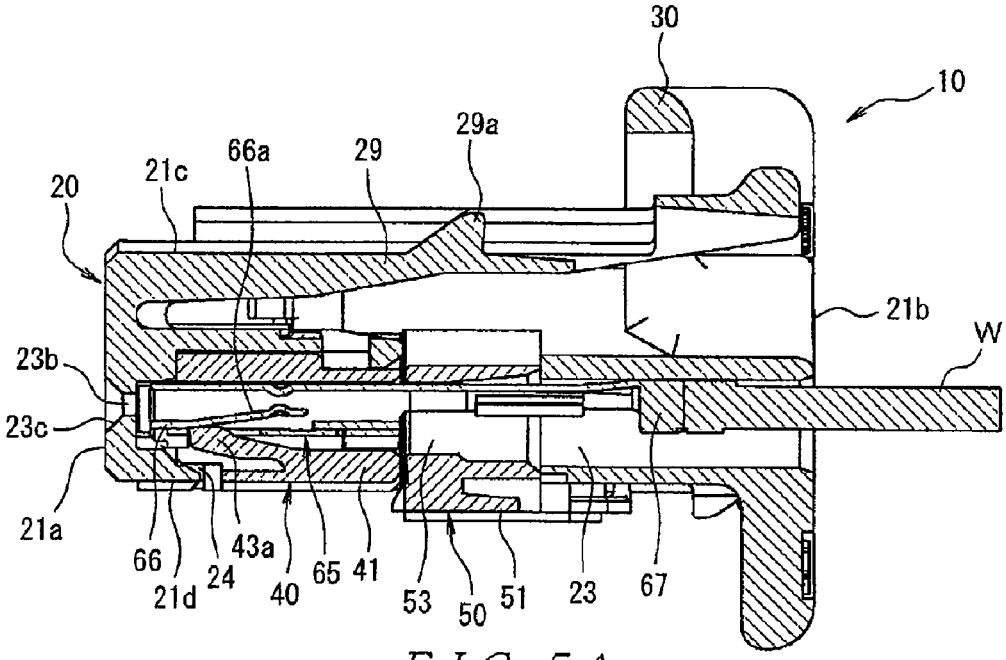
FIG. 5A is a sectional view along line 5A-5A in FIG. 4 showing a temporary locking state of a side retainer in the electrical connector according to the present invention.

As shown in FIG. 5A, the second contacts 65 are designed to be accommodated in the recessed member 24 of the housing 20 by passing through the second contact insertion holes 23 in the lower row from the side of the rear surface of the housing 20. As is the case with each of the first contacts 61, each of the second contacts 65 is constructed as a female contact and comprises a substantially box-form contact member 66 that receives one of the mating contacts 74 and contacts the mating contact 74. An electrical wire connecting member 67 extends rearward from the contact member 66 and is connected to one of the electrical wires W. An elastic contact piece 66*a* that contacts one of the mating contacts 74 is provided on each of the contact members 66. Each of the second contacts 65 may be formed, for example, by stamping and forming a metal plate.

When the electrical connector 10 mates with the mating connector 70, the mating contacts 74 are received by and make contact with the first contacts 61 and the second contacts 65 that are provided on the electrical connector 10, so that the electrical wires W connected to the first contacts 61 and the second contacts 65 are electrically connected to the circuit board.

As shown in FIGS. 5A-8C, a lance block 40 is accommodated in the recessed member 24 of the housing 20 by being inserted from the side of the lower surface, so that the primary locking of the first contacts 61 and the second contacts 65 is accomplished. As shown in FIGS. 9-11, the lance block 40 comprises a base 41 that extends in the left-right direction in dimensions that allow accommodation into the recessed member 24 of the housing 20. The lance block 40 is formed by molding an insulating resin. The base 41 is provided with a plurality of lance block through-holes 43 that are arranged in the left-right direction at the same pitch as the second contact insertion holes 23 and the second mating contact insertion holes 23*b* in the housing 20. Each of the lance block through-holes 43 has a width that allows the insertion of a second contact 65. Elastic lances 43*a* for the primary locking of the second contacts 65 are provided in the lance block through-holes 43. A plurality of second partition walls 42 that are aligned in the left-right direction and vertical direction with the first partition walls 22*a* provided on the housing 20 when the lance block 40 is accommodated in the recessed member 24 are provided above the lance block through-holes 43 of the base 41. The mutually adjacent second partition walls 42 are arranged at a distance that allows the insertion of a first contact 61 there between. The elastic lances 42*a* for the primary locking of the first contacts 61 are provided between the mutually adjacent second partition walls 42.

As shown in FIG. 9, third positioning projections 44 are provided on the upper ends of the second partition walls 42 in a shape that links the upper ends of mutually adjacent second partition walls 42. The third positioning projections 44 position the lance block 40 in the left-right direction by entering the openings 31 formed in the upper surface 21*c* of the housing 20, and also restrict the downward movement of the lance block 40 by contacting the shoulders 25*c* formed on the upper edge portions of the first partition walls 22*a* of the housing 20. As shown in FIGS. 9-10, a pair of elastic tongues 45 is provided on the left side surface and right side surface of the base 41 and extends rearward. As shown in FIGS. 2A-2B, locking projections 45*a* are provided on the rear ends of the elastic tongues 45. The locking projections 45*a* restrict the movement of the lance block 40 in the forward-rearward direction by entering the locking projection openings 26 in the housing 20. A first positioning projection 46 is provided on the upper surface of the base 41. The first positioning projection 46 restricts the forward and upward movement of the lance block 40 by entering the first positioning projection recessed member 25*a*. A plurality of second positioning projections 47 is provided on the front surface of the base 41. The second positioning projections 47 restrict the movement of the lance block 40 in the vertical direction by entering the second positioning projection recessed members 25*b*. As shown in FIGS. 6B and 11, a plurality of inclined surfaces 48 are formed at the lower corner edge of the rear surface of the base 41.

As shown in FIGS. 5A-8C, a side retainer 50 is accommodated in the recessed member 24 of the housing 20 by being inserted from the lower surface side, so that the secondary locking of the first contacts 61 and the second contacts 65 is accomplished. The side retainer 50 may be formed, for example, by molding an insulating resin. The side retainer 50 moves from a temporary locking position shown in FIGS. 5A-6C to a main locking position shown in FIGS. 7A-8C. The side retainer 50 performs the secondary locking of the first contacts 61 and the second contacts 65 when located in the main locking position. The side retainer 50 comprises a base 51 that extends in the left-right direction in dimensions that allow accommodation in the recessed member 24 of the housing 20, as shown in FIGS. 9-11. A plurality of side retainer through-holes 53 that are arranged in the left-right direction at the same pitch as the second contact insertion holes 23 and the second mating contact insertion holes 23*b* of the housing 20 are formed in the base 51. Each of the side retainer through-holes 53 has a width that allows insertion of the second contacts 65. A plurality of third partition walls 52 that are aligned in the left-right direction and vertical direction with the second partition walls 42 provided on the lance block 40 when the side retainer 50 is accommodated in the recessed member 24 of the housing 20 are provided above the side retainer through-holes 53 of the base 51. The mutually adjacent third partition walls 52 are formed at a distance that allows the insertion of the first contacts 61 there between.

As shown in FIGS. 2A-2B and 9-11, a pair of temporary locking projections 54 is provided on the left side surface and right side surface of the base 51. The temporary locking projections 54 restrict the downward movement of the side retainer 50 by engaging with the lower edge portions of the temporary locking projection openings 27*a* in the temporary locking position shown. A plurality of elastic members 55 are provided on the rear surface of the base 51 and protrude rearward. A main locking projection 55*a* is provided on each of the elastic members 55 and protrudes rearward. The main locking projections 55*a* restrict the upward movement of the side retainer 50 by contacting the protruding members 27*b* of the housing 20 from below in the temporary locking position, as shown in FIG. 6C. The main locking projections 55*a* restrict the movement of the side retainer 50 in the vertical direction by entering the slits 28 of the housing 20 in the main locking position, as shown in FIG. 8C. A plurality of pressing projections 56 that press the inclined surfaces 48 formed on the lance block 40 when the side retainer 50 is in the main locking position are formed on the front surface of the base 51. As a result, the side retainer 50 presses the lance block 40 in the forward direction, thus fastening the lance block 40 to the housing 20.

A method of assembling the electrical connector 10 will now be described. As shown in FIGS. 9-12C, the lance block 40 is inserted into the recessed member 24 from the side of the lower surface of the housing 20 and is moved in the forward direction, so that the lance block 40 is fastened to the housing 20. In order to fasten the lance block 40 to the housing 20, the first positioning projection 46 of the lance block 40 enters the first positioning projection recessed member 25*a* of the housing 20, as shown in FIG. 6A, to restrict the forward and upward movement of the lance block 40. The second positioning projections 47 of the lance block 40 enter the second positioning projection recessed members 25*b* of the housing 20, as shown in FIG. 6A, to restrict the movement of the lance block 40 in the vertical direction. The third positioning projections 44 of the lance block 40 enter the openings 31 in the housing 20, as shown in FIG. 6C, to position the lance block 40 in the left-right direction and restrict the downward movement of the lance block 40, as a result of the third positioning projections 44 contacting the shoulders 25*c* formed on the upper edge portions of the first partition walls 22*a* of the housing 20. The locking projections 45*a* of the lance block 40 enter the locking projection openings 26 in the housing 20, as shown in FIGS. 2A-2B, to restrict the movement of the lance block 40 in the forward-rearward direction. When the lance block 40 is accommodated inside the recessed member 24 of the housing 20, the second partition walls 42 of the lance block 40 are aligned in the left-right direction and vertical direction with the first partition walls 22*a* of the housing 20, as shown in FIG. 6B. The lance block through-holes 43 in the lance block 40 are aligned with the second contact insertion holes 23 and second mating contact insertion holes 23*b* in the housing 20.

Next, the side retainer 50 is inserted into the recessed member 24 of the housing 20 from the side of the lower surface of the housing 20 and is caused to be positioned in the temporary locking position. In this temporary locking position, the temporary locking projections 54 of the side retainer 50 enter the temporary locking projection openings 27*a* formed in the housing 20 and engage with the lower edges of the temporary locking projection openings 27*a* to restrict the downward movement of the side retainer 50, as shown in FIG. 9. The main locking projections 55*a* of the side retainer 50 contact the protruding members 27*b* of the housing 20 from below to restrict the upward movement of the side retainer 50. In the temporary locking position, the third partition walls 52 of the side retainer 50 are aligned in the left-right direction with the second partition walls 42 of the lance block 40, as shown in FIG. 6B, and the side retainer through-holes 53 in the side retainer 50 are aligned with the second contact insertion holes 23 in the housing 20 and the lance block through-holes 43 in the lance block 40, as shown in FIG. 5A.

As shown in FIG. 5B, in the temporary locking position, the first contacts 61 are inserted from the rear of the housing 20 toward the front between the first partition walls 22*a* of the housing 20 inside the recessed member 24. The first contacts 61 pass through the first contact insertion holes 22 in the upper row, between the third partition walls 52 of the side retainer 50, and between the second partition walls 42 of the lance block 40. The first contacts 61 are disposed coaxially with the first mating contact insertion holes 22*b*. The primary locking of the first contacts 61 is then accomplished by the elastic lances 42*a* of the lance block 40.

As shown in FIG. 5A, in the temporary locking position, the second contacts 65 are inserted from the rear of the housing 20 toward the front in the lance block through-holes 43 of the lance block 40 inside the recessed member 24. The second contacts 65 pass through the second contact insertion holes 23 in the lower row and the side retainer through-holes 53 in the side retainer 50. The second contacts 65 are disposed coaxially with the respective second mating contact insertion holes 23*b*. The primary locking of the second contacts 65 is then accomplished by the elastic lances 43*a* of the lance block 40.

Next, the side retainer 50 is moved further upward so as to be positioned in the main locking position. In the main locking position, the main locking projections 55*a* of the side retainer 50 ride over the protruding members 27*b* and enter the slits 28 in the housing 20 to restrict the movement of the side retainer 50 in the vertical direction, as shown in FIG. 8C. The pressing projections 56 of the side retainer 50 press the inclined surfaces 48 of the lance block 40 to press the lance block 40 in the forward direction, so that the side retainer 50 is fastened to the housing 20. As a result, the side retainer 50 is attached to the housing 20 by being accommodated inside the recessed member 24 of the housing 20.

Figure 7A:
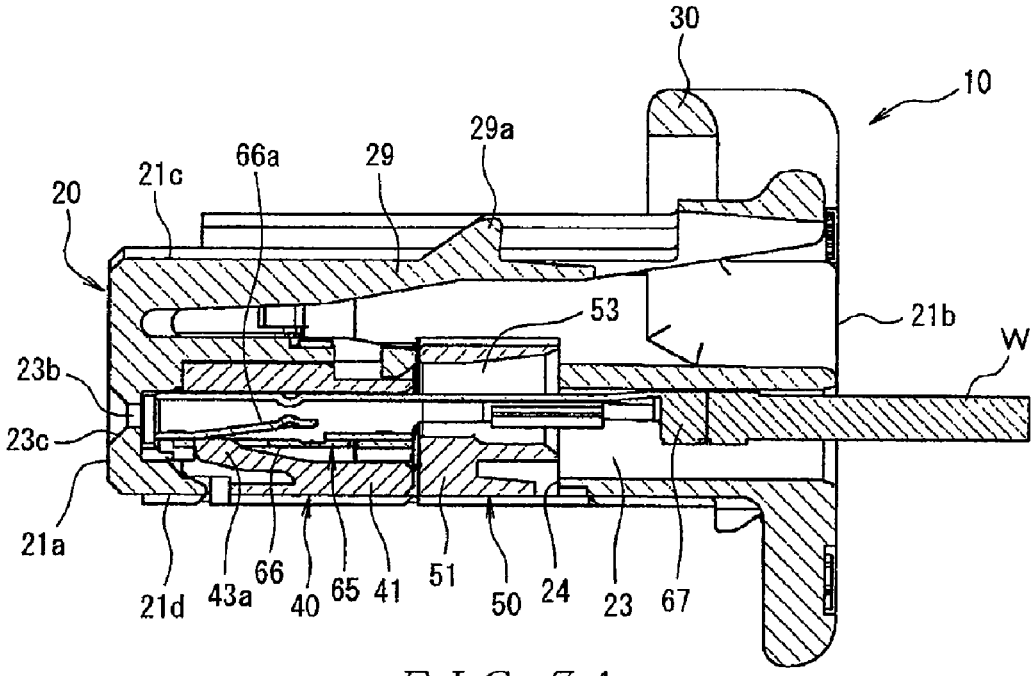
FIG. 7A is a sectional view along line 5A-5A in FIG. 4 showing a main locking state of the side retainer in the electrical connector according to the present invention.
Figure 7B:
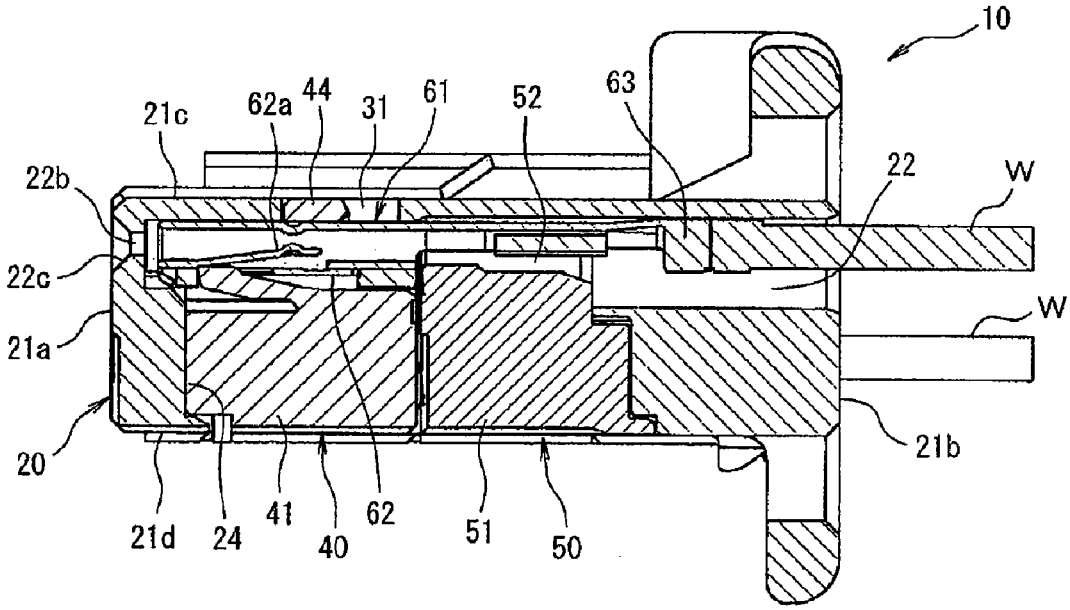
FIG. 7B is a sectional view along line 5B-5B in FIG. 4 showing the main locking state of the side retainer in the electrical connector according to the present invention.
Figure 8A:
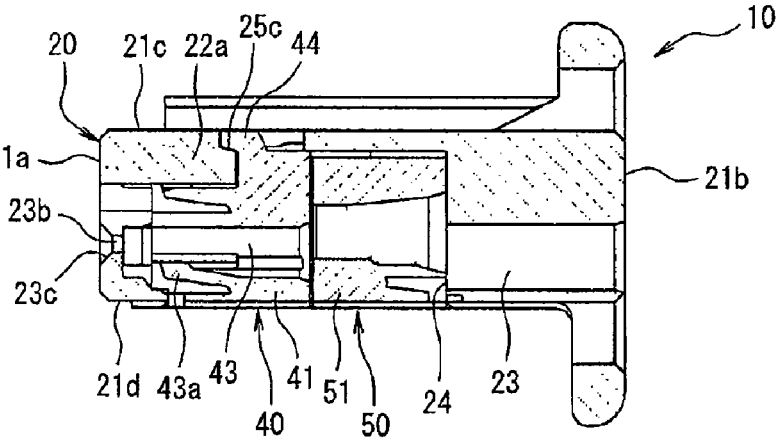
FIG. 8A is a sectional view showing the main locking state of the side retainer in the electrical connector according to the present invention in which both the third positioning projection of the lance block and a second contact insertion hole in the housing are cut.
Figure 8B:
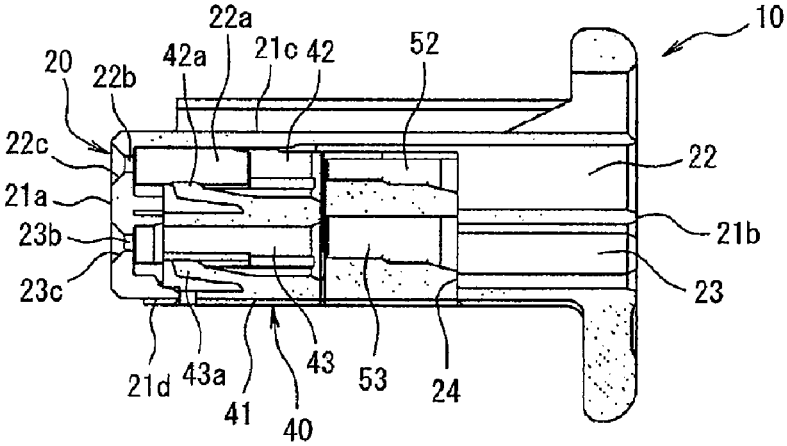
FIG. 8B is a sectional view showing the main locking state of the side retainer in the electrical connector according to the present invention in which both the first contact insertion hole and the second contact insertion hole in the housing are cut.
Figure 8C:
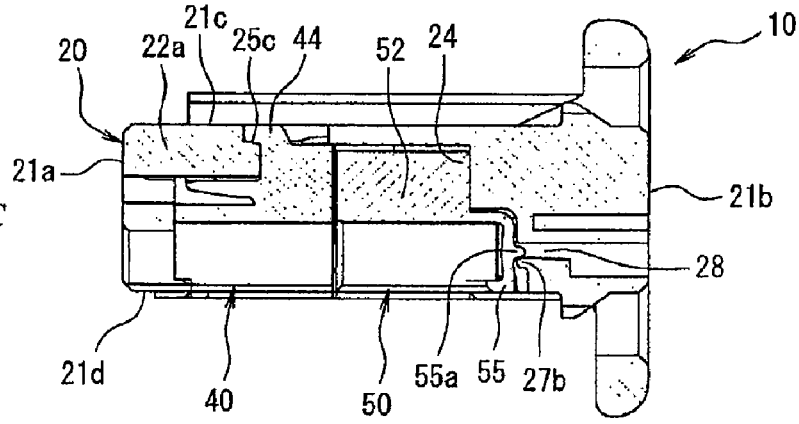
FIG. 8C is a sectional view showing the main locking state of the side retainer in the electrical connector according to the present invention in which both the third positioning projection of the lance block and the main locking projection of the side retainer are cut.

In the main locking position of the side retainer 50, as shown in FIG. 8B, the third partition walls 52 of the side retainer 50 are aligned in the vertical direction with the second partition walls 42 of the lance block 40. As shown in FIG. 7B, the front end surface of the base 51 below the third partition walls 52 performs the secondary locking of the first contacts 61, so that the first contacts 61 are prevented from slipping out. At the same time, as shown in FIG. 8B, the side retainer through-holes 53 in the side retainer 50 are positioned slightly above the second contact insertion holes 23 in the housing 20. As shown in FIG. 7A, the front end surface of the base 51 below the side retainer through-holes 53 performs the secondary locking of the second contacts 65, so that the second contacts 65 are prevented from slipping out. As a result of the secondary locking of the first contacts 61 and the second contacts 65 by means of the side retainer 50, the assembly of the electrical connector 10 is completed.

When the first contacts 61 or the second contacts 65 are to be removed from the housing 20, the side retainer 50 is first moved to the temporary locking position, so that the secondary locking of the first contacts 61 and the second contacts 65 is released. In this state, a temporary locking release tool (not shown) is caused to pass through the tool insertion holes 33, 34 from the front of the housing 20, so that the primary locking of the first contacts 61 or the second contacts 65 by the elastic lances 42*a* or the elastic lances 43*a* may simply be released.

In the electrical connector 10 according to the invention, the primary locking of the first contacts 61 and the second contacts 65 is accomplished by the lance block 40 that is inserted in the recessed member 24 from the side of the lower surface of the housing 20, and the secondary locking of the first contacts 61 and the second contacts 65 is accomplished by the side retainer 50 accommodated in the recessed member 24 from the side of the lower surface. Accordingly, even if the height in the vertical direction and the width in the left-right direction are reduced by making the walls of the housing 20 thinner, it is possible to provide an electrical connector 10 in which a sufficient contact holding force is obtained.

In addition, because the lance block 40 that is a separate body from the housing 20 is accommodated in the recessed member 24 of the housing 20, there is no need to form any housing lances for the primary locking of the first contacts 61 and the second contacts 65 by molding simultaneously with the housing 20, and interpole walls can be provided on the front surface 21*a* of the housing 20 between the adjacent first mating contact insertion holes 22*b* and between the adjacent second mating contact insertion holes 23*b* in positions corresponding to the first contacts 61 and the second contacts 65. As a result, it is possible to form tool insertion holes 33, 34 in the mating surface of the housing 20 corresponding to the first contacts 61 and the second contacts 65. Accordingly, even if the pitch in the arrangement of the first contacts 61 and the second contacts 65 becomes narrow, the introduction of the tip end of the temporary locking release tool (not shown) into the positions of the specified first contacts 61 and second contacts 65 becomes easy, so that there is no interference with the release operation of the elastic lances 42*a*, 43*a*.

Further, the lance block 40 is constructed so that the lance block 40 is inserted into the recessed member 24 from the side of the lower surface of the housing 20 and moved in the forward direction, so that the lance block 40 is attached to the housing 20. The side retainer 50 is attached to the housing 20 by being inserted into the recessed member 24 from the side of the lower surface of the housing 20 and presses the lance block 40 in the forward direction to fasten the lance block 40 to the housing 20. Accordingly, the lance block 40 is fastened in place by the side retainer 50, which makes it possible to produce an electrical connector 10 in which an even greater contact holding force can be obtained.

The foregoing illustrates some of the possibilities for practicing the invention. For example, it will be appreciated by those skilled in the art that the first contacts 61 and the second contacts 6 may alternatively be male contacts. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector comprising:

a housing having opposing upper and bottom surfaces and opposing rear and front surfaces, the housing having a recessed member provided with a plurality of contacts, the contacts being arranged in at least one row and extending from the rear surface toward the front surface of the housing;

a lance block insertable into the housing from the bottom surface, the lance block having elastic lances corresponding to the contacts, the elastic lances engaging the contacts to primarily lock the contacts in the housing; and a side retainer insertable into the housing from the bottom surface, the side retainer pressing the lance block toward the front surface when the side retainer is moved from a temporary locking position into a main locking position to lock the lance block in the housing, the side retainer secondarily locking the contacts in the housing in the main locking position.

2. The electrical connector of claim 1, the housing has a plurality of mating contact insertion holes formed in the front surface of the housing in positions corresponding to the contacts and interpole walls are provided between each of the mating contact insertion holes.

3. The electrical connector of claim 1, wherein the contacts are female contacts.

4. The electrical connector of claim 1, wherein the side retainer presses the lance block toward the front surface when the side retainer is moved toward the upper surface.

5. The electrical connector of claim 1, wherein the side retainer includes pressing projections that engage inclined surfaces of the lance block to press the lance block toward the front surface.

6. The electrical connector of claim 1, wherein the housing is provided with at least one tool insertion hole that receives a temporary locking release tool for releasing the elastic lances from the contacts.

7. The electrical connector of claim 1, wherein the front surface is the mating surface.

8. The electrical connector of claim 1, wherein the lance block includes at least a first positioning projection that restricts movement of the lance block in the housing.

9. The electrical connector of claim 1, wherein the side retainer includes a temporary locking projection that restricts movement of the side retainer in the housing.

10. An electrical connector comprising:

a housing having a recessed member provided with a plurality of contacts, the contacts being arranged in at least one row and extending from a rear surface toward a front surface of the housing;

a lance block insertable into the housing in a direction substantially perpendicular to the contacts, the lance block having elastic lances corresponding to the contacts, the elastic lances engaging the contacts to primarily lock the contacts in the housing; and a side retainer insertable into the housing in a direction substantially perpendicular to the contacts, the side retainer pressing the lance block in a direction substantially parallel to the contacts when the side retainer is moved from a temporary locking position into a main locking position to lock the lance block in the housing, the side retainer secondarily locking the contacts in the housing in the main locking position.

11. The electrical connector of claim 10, the housing has a plurality of mating contact insertion holes formed in the front surface of the housing in positions corresponding to the contacts and interpole walls are provided between each of the mating contact insertion holes.

12. The electrical connector of claim 10, wherein the contacts are female contacts.

13. The electrical connector of claim 10, wherein the side retainer presses the lance block in the direction substantially parallel to the contacts when the side retainer is moved in a direction substantially perpendicular to the contacts.

14. The electrical connector of claim 10, wherein the side retainer includes pressing projections that engage inclined surfaces of the lance block to press the lance block in the direction substantially parallel to the contacts.

15. The electrical connector of claim 10, wherein the housing is provided with at least one tool insertion hole that receives a temporary locking release tool for releasing the elastic lances from the contacts.

16. The electrical connector of claim 10, wherein the front surface is the mating surface.

17. The electrical connector of claim 10, wherein the lance block includes at least a first positioning projection that restricts movement of the lance block in the housing.

18. The electrical connector of claim 10, wherein the side retainer includes a temporary locking projection that restricts movement of the side retainer in the housing.

* * * * *